United States Patent [19]

Stoltz

[11] Patent Number: 4,638,922

[45] Date of Patent: Jan. 27, 1987

[54] SHAKE COMPENSATED HOLE-PUNCHED PRODUCT VENDING SYSTEM

[75] Inventor: J. Stephen Stoltz, Conway, Ark.

[73] Assignee: Stoco Industries, Inc., Conway, Ark.KANSAS

[21] Appl. No.: 742,019

[22] Filed: Jun. 6, 1985

[51] Int. Cl.[4] ..... G07S 11/36

[52] U.S. Cl. ..... 221/75; 221/281

[58] Field of Search ..... 221/75, 277, 281; 198/659, 661, 676

[56] References Cited

U.S. PATENT DOCUMENTS

| | | | |
|---|---|---|---|
| 3,248,005 | 4/1966 | Joschko | 221/75 X |
| 3,294,281 | 12/1966 | Schlaf | 221/75 X |
| 3,355,064 | 11/1967 | Schlaf | 221/75 X |
| 4,018,359 | 4/1977 | Lambert | 221/75 X |

*Primary Examiner*—Charles A. Marmor

*Attorney, Agent, or Firm*—Stephen D. Carver

[57] ABSTRACT

A helical vending module having dual diameter convolutions, and a vending machine equipped with a plurality of such modules. Preferably the vending machine comprises a generally cubical cabinet including a front service door equipped with a translucent panel facilitating visual exposure of the cabinet interior. Suitable conventional coin acceptor apparatus is provided to effectuate a vend when a particular product is selected by conventional control apparatus, and when a product is vended the selected module helice will rotate to effectuate a vend. The product will then drop downwardly into a customer accessible access zone. Each of the modules preferably comprises a rigid, generally planar frame which is adapted to be secured to an inclined supporting surface within the vending machine. The module frame support an outwardly projecting helical spindle coupled to an associated drive motor. The spindle includes convolutions of a first predetermined diameter along a major portion of its length, and the spindle terminates at its outwardly projecting end in integral larger diameter convolutions. The punched product to be vended is disposed between each of the adjacent convolutions when the spindle is fully loaded. A generally rectangular, rearwardly biased cover plate hinged to the frame extends outwardly from the face plate above the spindle. The terminal end of the cover plate includes an integral, downwardly turned tab, which supports a security bar which extends toward the module frame and generally coaxially penetrates at least a portion of the larger diameter spindle convolutions to prevent products from being dislodged in response to shaking of the machine.

4 Claims, 13 Drawing Figures

SHAKE COMPENSATED HOLE-PUNCHED PRODUCT VENDING SYSTEM

BACKGROUND OF THE INVENTION

The present invention relates generally to helical vending machines for dispensing punched products. More particularly, the present invention relates to vending machine technology wherein helical modules are employed to serially dispense hole punched products in response to the prior selection by a customer.

In the prior art it is well known to employ some form of helical device to effectuate a vend. Known prior art vending machines which incorporate spiraled dispensers in the form of helices include U.S. Pat. No. 921,763, issued May 18, 1909; U.S. Pat. No. 3,178,055, issued Apr. 13, 1965; U.S. Pat. No. 3,344,953 issued Oct. 3, 1967; and, U.S. Pat. No. 3,653,540 issued Apr. 4, 1972.

Such prior art devices disclose the well known use of elongated helices which physically move "non-punched" products to be vended between adjacent windings or convolutions. Conventional motor means associated with helices typically rotate them one revolution in response to proper coin validation, whereupon a product is vended outwardly of the terminus of the helix. However, the previously mentioned patents do not direct themselves to the vending of hole punched products.

A relatively recent development is the multiple module helical vending machine for dispensing 'punched products.' Typical known prior art vending machines usually include an upright, generally cubical cabinet adapted to be disposed upon a supporting surface, in which a plurality of individual helical dispensing rows or modules are mounted. Preferably such machines include a front door permitting service access, which front door includes a translucent panel whereby customers may view the product selection. Internally of the cabinet an angled mounting surface is usually defined for supporting a plurality of orderly spaced apart rows and columns of individual helice-equipped vending modules. Each helice penetrates and supports a plurality of containers (i.e. bags) of product to be vended. Those rows of modules operationally disposed at the top of the machine project forwardly further than the next lower row of modules, so that selected products may drop in unobstructed fashion downwardly through the front of the machine into a product vend chute accessible by the customer. Upon the input of a proper token value to conventional coin acceptance apparatus, a vend will be effectuated by momentarily energizing the motor associated with the appropriate module to rotate the associated helice a full turn, thereby effectuating a vend by "unwinding" a bag or container from the helice.

For a variety of reasons machinery adapted to vend hole punched products is ideal. For example, a small bag of food product having an appropriately reinforced and punched hole at the top of its bag may be coupled to a dispensing helice with a minimum of effort by the servicing technician. These products, the containers for which include a pre-punched orifice for spindle penetration, are carried between adjacent windings of forwardly projecting helices. Product is dispensed when the helices rotate, and less friction is developed. Most importantly, enhanced, vending machine reliability has historically been obtained through the use of helices in conjunction with conventional "punched products."

U.S. Pat. No. 3,752,287 issued Aug. 14, 1973 discloses a generally cubical vending machine of upright dimensions which includes a translucent, front surface access door. A plurality of individual dispensing modules (although not involving helices) are shown. This particular reference discloses how a particular coin mechanism may be electrically wired to effectuate a vend of a given module. The customer merely selects one of a variety of push buttons corresponding to a particular dispensing module which he can see through the windown, inserts the appropriate amount in coinage, and a vend is effectuated through the bottom of the machine to a vend position accessible by a push or hand operated vend access door. U.S. Pat. No. 3,734,346 discloses a similar vending machine cabinet arrangement, in which anti-theft apparatus is associated with the product access door.

U.S. Pat. No. 3,757,993 discloses a "multiple module" vending machine in which a plurality of individual vending modules are included. These vending modules each include a chain driven apparatus dissimilar from the helice construction of the present invention. Similar "hook and tab" and or chain driven dispensing modules are seen in U.S. Pat. Nos. 3,756,455 and 3,716,165 to Patrick.

U.S. Pat. No. 3,294,281, issued to S. Schlaf on Dec. 27, 1966 is one of the most relevant prior art references known to me. This device broadly discloses an upright generally cubical vending machine in which a plurality of helical dispensing modules are disposed in an orderly fashion to effectuate a customer selected vend. Each of the modules includes an outwardly projecting helice, between the convolutions of which are disposed a number of hole punched products. Motor means are provided whereby after the input of an appropriate value of coins the customer may select his product and a vend will occur. Vending is accomplished by internal rotation of the selected helice one revolution until the most extreme punched product held thereby is dropped through the front of the machine into a customer access area. Similarly, U.S. Pat. Nos. 3,355,064 and 3,572,546 also employ multiple, outwardly extending helices in which a plurality of hole punched products are disposed between adjacent convolutions. Helical vending is also shown in U.S. Pat. No. 3,690,510 to Deaton issued Sept. 12, 1972.

While helical vending machines for dispensing hole punched products are well established in the industry, present designs known to me nevertheless are not immune from certain vexatious defects. Many of the problems in the art result from the strenuous demands placed upon the machines. Such machines may be located in "unwatched" areas, subjecting them to frequent attacks of vandalism. The machines may also be subject to extreme temperature and humididity fluctuations. Most importantly, a commercially worthwhile machine must be inherently reliable, and some for of theft or vandilism protection must of course be included. Moreover, for an economically efficient chain of machines to be adequately maintenanced, they must be capable of being service quickly and efficiently by the field representatives.

One of the most difficult and vexatious problems experienced by both vending machine manufacturers and operators relates to product theft. For example, with known helical vending machines products may often be dispensed by thieves who may vigorously kick, pound, or shake the machine. Accordingly, it would seem desirable to provide some form of operational guide associated with the helice whereby unauthorized vends are rendered impossible. On the other hand, where guards or theft protection devices of improper design are employed, such structure overly complicates the design of the apparatus and unnecessarily interferes with service and maintenance efficiency.

Hence I have found it desirable to provide a helical vending machine module and a vending machine equipped with same which provides the hitherto realized advantages of helical hole punched product vending, but which redresses problems relating to the "theft" of product. Specifically, I have provided a means whereby product is prevented from ejection from the helices in response to machine shaking or shock. Moreover, the instant system is readily compatible with the service necessity of ease of maintenance and the attendant requirements of quick product reloading. Additionally, the present modules may be retrofitted where necessary into existing machines.

SUMMARY OF THE INVENTION

The present invention comprises a helical vending module having dual diameter convolutions, and a vending machine equipped with such modules.

The vending machine constructed in accordance with the teachings of the present invention preferably comprises an upright, generally cubical cabinet which is adapted to be disposed upon a suitable supporting surface. The cabinet preferably comprises a front access door enabling the serviceman to maintenance the device, and the service door preferably includes a translucent panel which facilitates visual exposure of the products to be vended to the customer.

It is preferred that a generally planar, angled mounting surface is defined internally of the machine for supporting a plurality of modules. Suitable conventional coin validation apparatus is provided to effectuate a vend when a particular product module is selected by conventional apparatus, and when a desired product is vended the selected helice will rotate to effectuate a vend. The product will then drop downwardly through the front of the vending machine into a customer accessible zone, entry to which is preferably provided by a manually operable door.

Each of the modules preferably comprises a rigid frame in the form of a generally planar face plate which is adapted to be secured to the supporting surface within the vending machine. The face plates support a front mounted, outwardly projecting module equipped with a helical spindle rotatably coupled to a suitable conventional drive motor, which is preferably secured at the rear of the planar face plate. The spindle includes convolutions of a first predetermined diameter along a major portion of its length, and the spindle terminates at its outwardly projecting end in integral larger diameter convolutions. The punched product to be vended is disposed between each of the adjacent convolutions when the spindle is fully loaded.

Preferably an elongated, generally rectangular cover extends outwardly from the face plate above the spindle. This cover includes a pair of angled, downwardly projecting tabs, which are preferably hingeably secured at the bottom of an associated mounting bracket. The opposite side of the mounting bracket is hingeably coupled to the face plate or module frame, and it is spring biased rearwardly so as to normally draw the cover plate towards the module frame. The terminal end of the cover plate includes an integral, downwardly turned tab, which supports a security bar which extends toward the frame of the module and generally coaxially penetrates at least a portion of the larger diameter convolutions at the end of the spindle.

Because of the spring bracket mounting system, the service man may manually grasp the cover plate, move it forward, and then move it upwardly after the associated security bar clears the spindle. However, in the normal operative state those punched products disposed at the front of the spindle, (i.e. those products about to be vended) are secured between the lowermost edges of the larger diameter convolutions and the security bar. Hence shocks experienced by the module in response to vandalism or the like prevent an inadvertent vend.

Each of the loaded vending module spindles are visible by a potential consumer through the front door of the machine. Upon the input of suitable coins into conventional coin acceptor means and the selection of a product, a vend will be effectuated as that particular module will be actuated. Upon module actuation the spindle will complete one full rotation and the product will be vended as it is forced through the last winding of the spindle between the lowermost portion of the convolutions thereof and the security rod. Each successive product disposed on the spindle will concurrently be moved toward the vend position, since it is captured between adjacent spindle convolutions and rotation of the product is prevented by the associated cover. Since the machine interior is visible, it will be readily apparent to a potential customer when a product is sold out, so that he will not select that particular module. However, subsequent service by the field representative will be readily facilitated, since he need merely open the vending machine access door, grasp the cover plate and swing it out of the way, and then unload the helice from its drive hub associated with the motor.

Hence a fundamental object of the present invention is to prevent unauthorized vends from helical vending machines which may otherwise result in response to shock, shaking, or the like.

A similar object of the present invention is to provide a helical vending module and a vending machine equipped therewith which resists shaking or other shocks to prevent unauthorized vends but which is readily serviceable by the field service personnel who must maintenance the vending machines.

Yet another object of the present invention is to provide a security bar system to prevent unauthorized vends from helical vending machines and helical vending modules.

Yet another object of the present invention is to provide a helical vending module of the character described which may be readily retrofitted into existing machines in the field.

A still further object of the present invention is to provide a theft resistant vending module of the character described which may be readily serviced by suitable personnel.

Yet another object of the present invention is to provide a cover bar assembly for helical vending machines with a shake-resistant system for preventing unauthorized vends.

Similarly, it is an object of the present invention to provide a helical vending module with a cover plate security system which will function reliably and dependably in the field notwithstanding attempts at theft, but which will nevertheless be capable of readily efficient and accessible servicing by authorized vending machine maintenance personnel.

These and other objects and advantages of the present invention, along with features of novelty appurtenant thereto, will appear or become apparent in the course of the following descriptive sections.

BRIEF DESCRIPTION OF THE DRAWINGS

In the appended drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
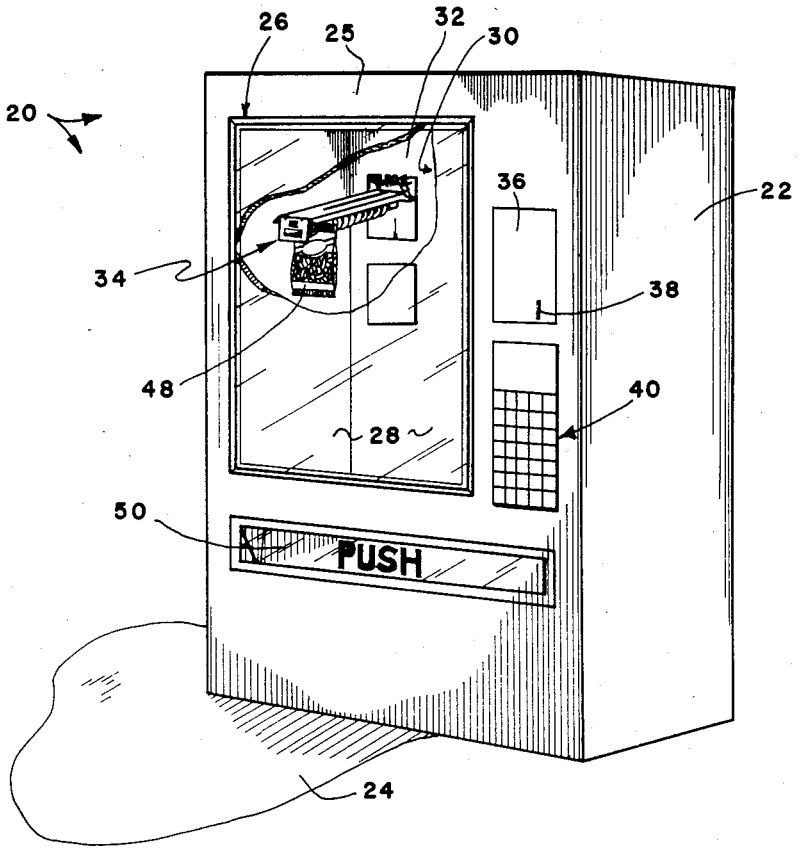
FIG. 1 is a fragmentary, perspective view of a vending machine constructed in accordance with the teachings of the present invention, with portions thereof omitted for clarity.
Figure 2:
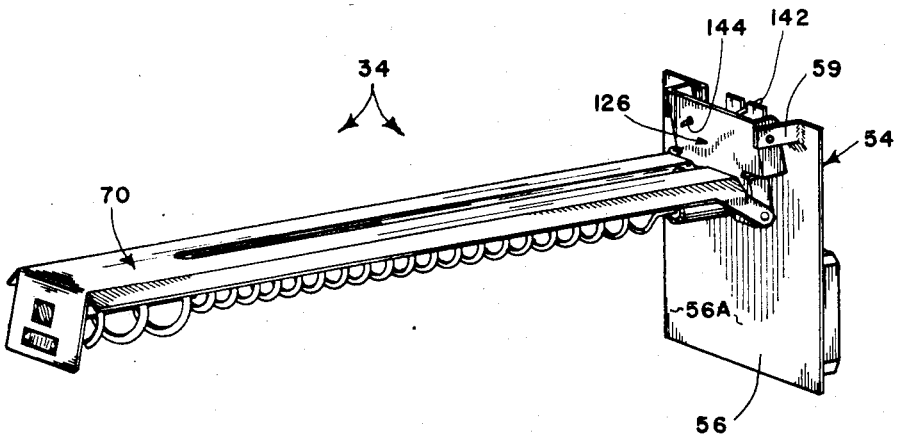
FIG. 2 is an isometric view of a preferred module incorporating the teachings of the present invention.
Figure 3:
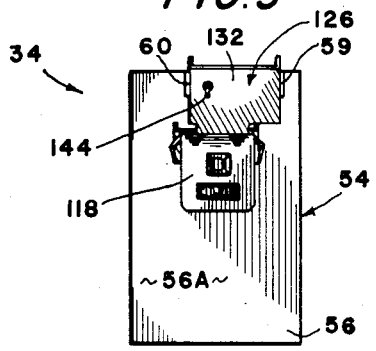
FIG. 3 is a front plan view of a preferred dispensing module, taken from a position generally to the left of FIG. 2.

With initial reference now to FIG. 1 of the appended drawings, the reference numeral 20 broadly designates a multiple spindle vending machine constructed in accordance with the best mode of the present invention. Vending machine 20 includes an upright, generally cubical enclosure 22 adapted to be disposed upon a suitable supporting surface 24. Vending machine 20 preferably comprises a front face 25 upon which a suitable maintenance access door 26 is hingeably secured. Door 26 includes a conventional translucent panel 28 facilitating customer viewing of the interior 30 of the vending machine. Interiorly of the machine is a conventional upwardly sloping support panel 32 upon which a plurality of vending modules 34 are disposed. Each module includes a helical spindle projecting toward door 26.

As appreciated by those skilled in the art, a conventional coin acceptance mechanism 36 is included whereby coins may be inserted through a slot 38 to effectuate a vend. Afterwards, selection panel 40 may be acuated to effectuate a proper vend. The panel includes a plurality of push buttons which may be conventionally numbered in correspondence with numbers visibly located upon the vending modules to facilitate customer product selection. Thus a desired product 48 may be selected.

When a selection occurs after proper coin validation, the vended product will be dispensed from the selected helical vending module 34, and it will drop down through the forward interior of vending machine 20 into a vending access area behind the customer actuated retrieval gate 50.

With additional reference directed now to FIGS. 2–13, each module 34 preferably comprises a rigid, generally planar frame member 54 including a generally rectangular, planar face plate 56 which is integral with a pair of spaced apart flanges 59, 60 which, as will hereinafter be described in detail, hingeably mount an associated cover plate assembly 70. The frame plate 56 includes a front side or surface 56A from which the spindle assembly 74 outwardly projects and a rear surface 56B (FIG. 4) upon which a suitable conventional motor assembly, generally designated by the reference numeral 80, is mounted.

With reference now to FIGS. 4–6, and 10–13, the motor assembly 80 typically comprises a conventional electrical alternating current motor 82 which is coupled to a gear box 84. The gear box drives a hub, generally designated by the reference numeral 90 (FIG. 13), which includes a rigid, generally cylindrical outer shell 85 and a preferably plastic, internal slotted fitting 92. As best viewed in FIG. 13, fitting 92 receives the keyed drive terminus 88 of the spindle assembly 74, which is thus rotated thereby.

Figure 4:
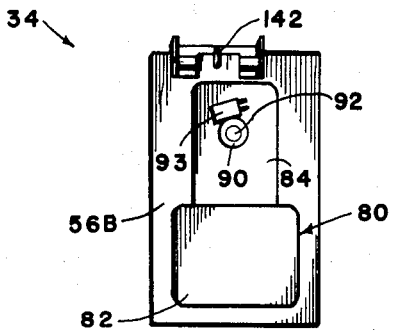
FIG. 4 is a rear plan view of the preferred dispending module as viewed from a position generally to the right of FIG. 2.

As viewed in FIG. 4 the rear end of the gear box hub portion 90 mechanically controls a conventional switch 93 for timing purposes, whereby only one rotation of the spindle assembly 74 will be allowed per vend. The motor assembly 80 is conventional, and suitable motor assemblies have previously been described in detail in such references as U.S. Pat. Nos. 3,294,281 and/or 3,572,546, which are herein incorporated in by reference.

Figure 9:
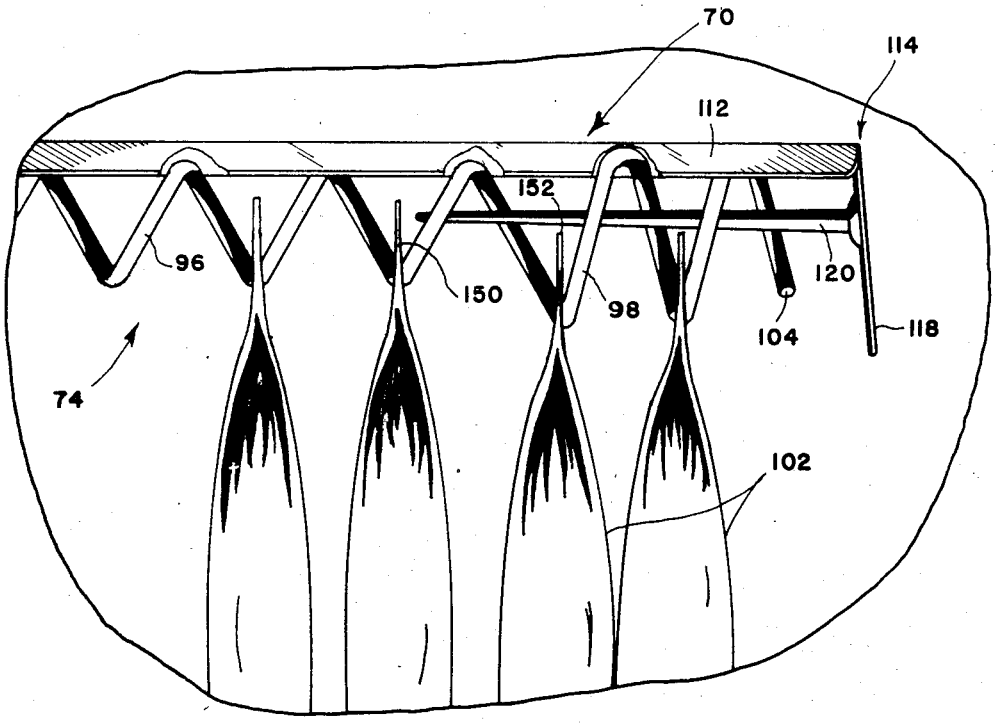
FIG. 9 is an enlarged, fragmentary elevational view of the preferred module shown carrying a plurality of products to be vended, and with the cover plate and security rod disposed in the normal operational position.

With reference now to FIGS. 2, and 5–13, the spindle assembly 74 comprises a helical spindle formed of a plurality of convolutions 96 integral with terminal, axially aligned convolutions 98 of a somewhat larger diameter. In other words, throughout a major portion of the length of the helice assembly 74 its diameter is that of helices 96, but the terminal helices 98 are of a larger diameter. The entire spindle is removably fitted via its previously described terminus 88 and keyed for rotation through the illustrated structure (FIG. 13) to the associated motor and gear reduction system. As best illustrated in FIG. 9, and as will hereinafter be explained in detail, punched bags or containers such as products 102 (FIG. 9) are disposed between adjacent convolutions. Thus, punched products 102 normally hang down between the lowermost portions of adjacent convolutions, and in response to rotation of the spindle products are forced to move to the right, (as viewed in FIG. 9). Once a product clears the terminal end 104 of the helical spindle, they will separate from the module 34 and drop downwardly within the vending machine 20.

The cover plate assembly 70 comprises an elongated, generally rectangular and rigid main body portion 110 which is reinforced by an elongated groove 111 and which includes a pair of opposite, parallel, and downwardly angled edges 112. The terminal end of the cover plate, generally designated by the reference numeral 114, includes an integral, downwardly projecting tab 118 which supports a rigid, rearwardly projecting security bar 120.

Figure 5:
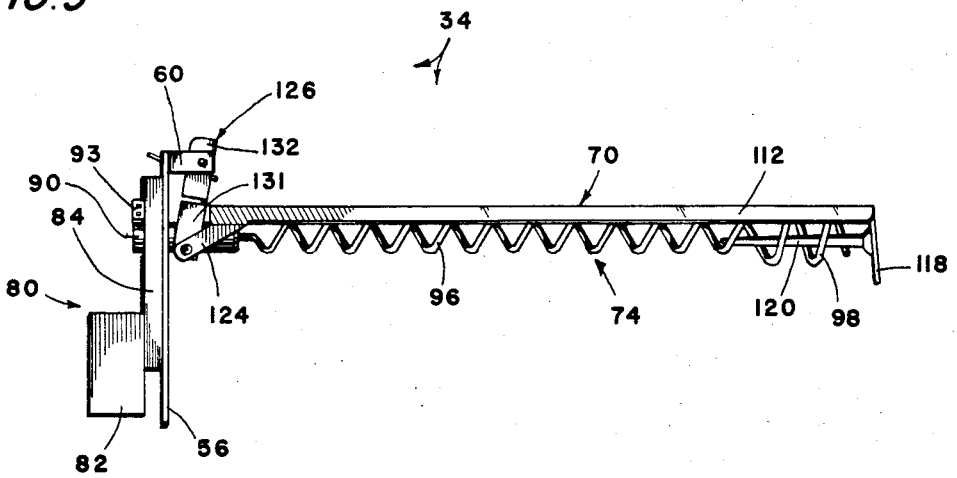
FIG. 5 is a left side elevational view of the preferred module.
Figure 6:
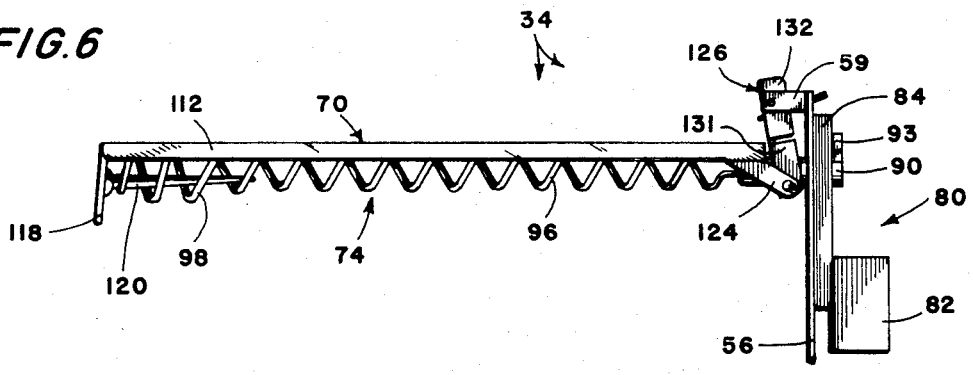
FIG. 6 is a right side elevational view of the preferred vending module.
Figure 11:
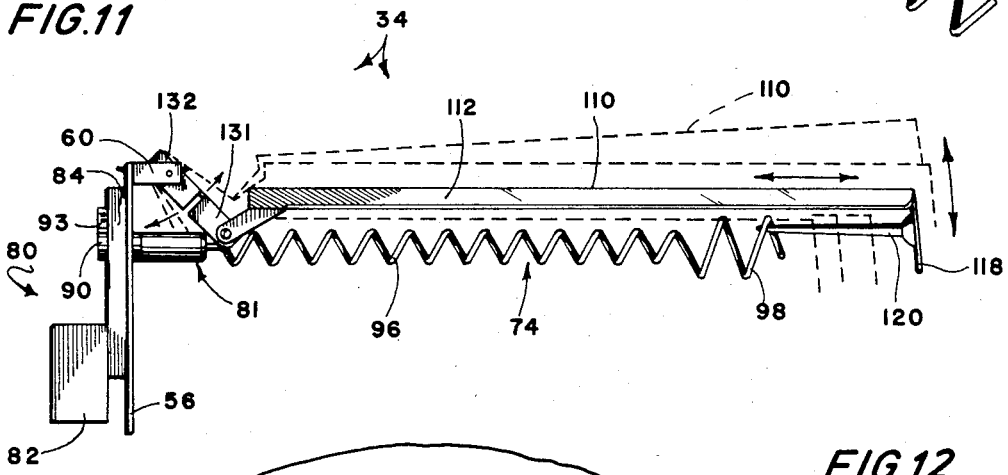
FIG. 11 is a side elevational view of an unloaded dispensing module constructed in accordance with the teachings of the present invention, with moved positions of the cover plate assembly shown in dashed lines.
Figure 12:
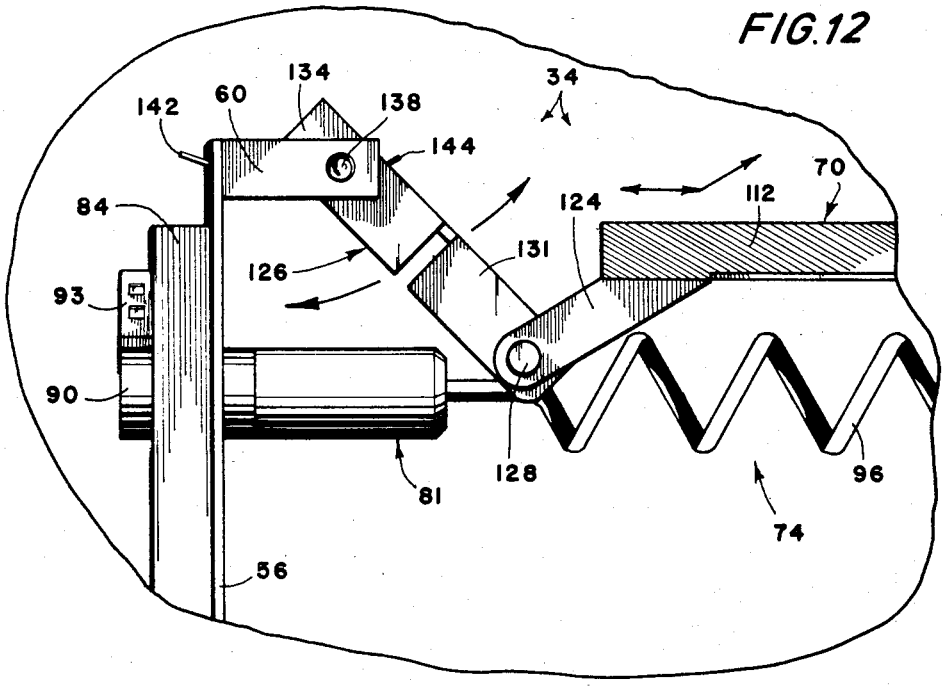
FIG. 12 is an enlarged, fragmentary elevational view illustrating a portion of the vending machine module in its serviceable position; and, FIG. 13 is an enlarged, fragmentary, sectional view.

As best viewed in FIGS. 5, 9, and 11, the security bar 120 extends rearwardly toward the frame or face plate 56, and generally coaxially penetrates the larger diameter spindle convolutions 98. The opposite end of the cover bar 110 terminates in downwardly angularly projecting tabs 124 which are hingeably coupled to a mounting bracket, generally designated by the reference numeral 126 at opposite sides thereof. Preferably an appropriate rivet 128 (FIG. 12, 13) fastens each of these tabs 124 upon lower sides of the bracket 126. The uppermost portion 132 of the bracket 126 is hingeably coupled between frame tabs 59, 60 previously described with an axle member 134 is journalled between tabs 59 and 60 and is rotatably secured by appropriate rivets 138.

Figure 7:
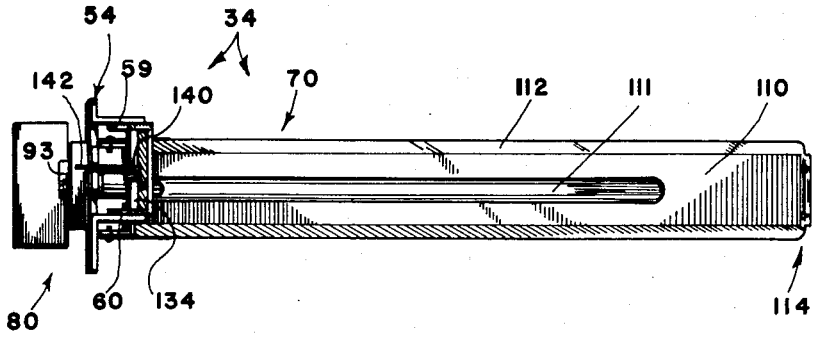
FIG. 7 is a top plan view of the preferred module.
Figure 8:
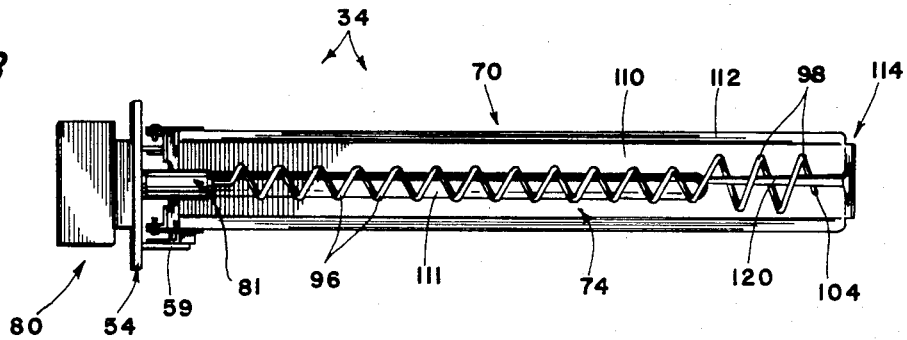
FIG. 8 is a bottom plan view of the preferred module.
Figure 10:
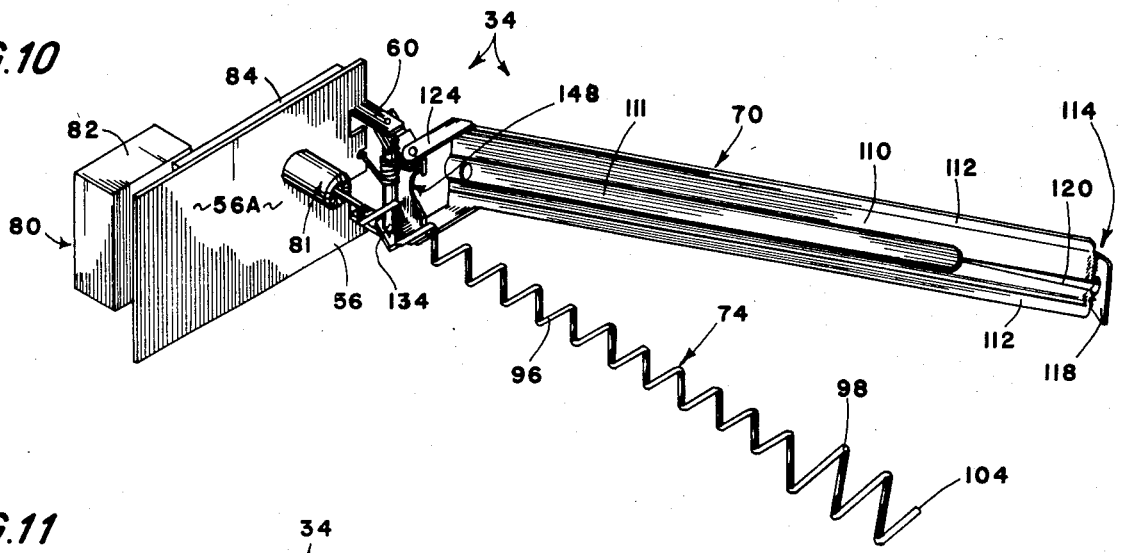
FIG. 10 is an isometric view of an unloaded module constructed in accordance with the teachings of the present invention, with the cover plate assembly deflected to a serviceable position.
Figure 13:
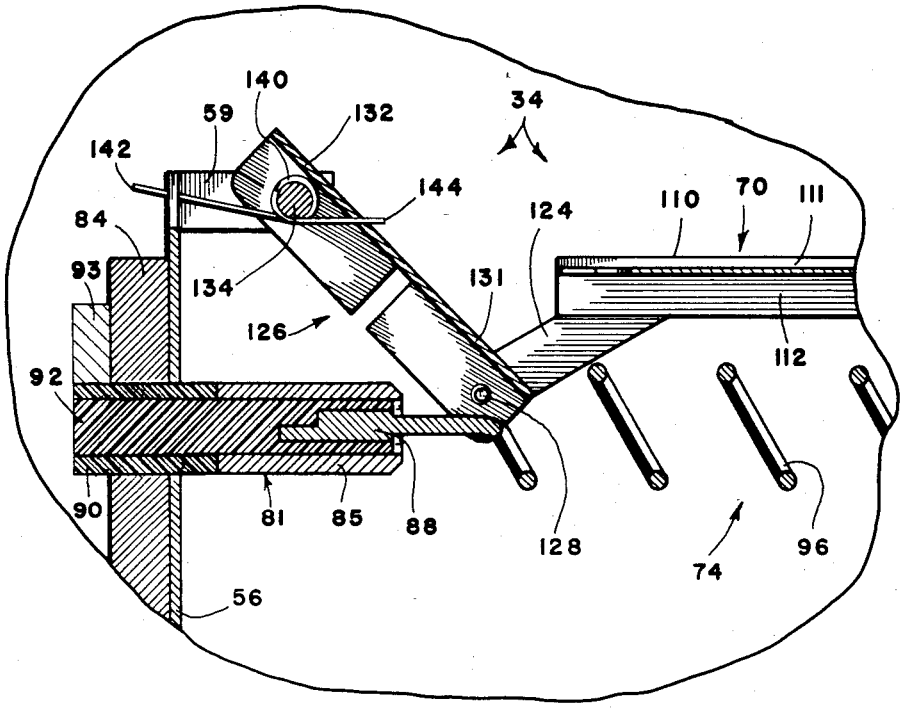

As best viewed in FIGS. 7, 10 and 13, axle 134 captures a spring 140, end 142 of which is retained within a suitable notch formed in frame 56 (FIG. 10) and the opposite end 144 of which (FIG. 13) penetrates bracket 126 to bias the bracket and the entire cover plate assembly 70 towards the frame 56. As best viewed in FIG. 10, the bracket includes an integrally defined notch 148 which, when the apparatus assumes a position illustrated in FIG. 2, "clears" the spindle drive hub previously described. Moreover, because of the bias provided by spring 140, the security bar 120 is drawn inwardly of the outer convolutions 98 of the spindle assembly 74.

Thus prior to a vend it is to be assumed that the spindle is appropriately loaded as shown in FIG. 9. At this time the tabbed upper portions 150 of the bagged products 102 will rest in the lowermost apexes of adjacent convolutions. However, the uppermost tips 152 (FIGS. 9, 14) of each container disposed within and between the larger diameter helical windings 98 will be captured between these convolutions and the upper security rod 120. The tops of those bags located between lesser diameter windings 96 will be disposed in close propinquity to the underside of the reinforcement groove 111 (FIG. 7), which may on occasion contact the bags during a vend to secure them and prevent rotation. Thus improper vends are avoided since unwanted bag travel is resisted. If shaking of the vending machine occurs product(s) cannot escape around the terminal helice end 104 of the appropriate spindle.

Service of the apparatus is facilitated since the serviceman may merely grasp the cover bar assembly 70 and move it axially away from the frame 56. Thus by grasping the cover bar assembly it may be axially moved away from the face plate as the bracket 126 is caused to rotate about the center of rotation established by axle 134. At this time the lowermost portion 131 of the bracket 126 will clear the spindle assembly, the previously described notch 148 (FIG. 10) having been provided for this purpose. The various parts will move as shown in the directions shown by the bold arrows illustrated in FIGS. 11 and 12, and the positions illustrated in dashed lines in FIG. 11 may be assumed.

It will be apparent that as the cover plate assembly 70 elongages to the most extreme position shown in FIG. 11, security rod 120 will become disengaged from the spindle convolutions 98, so that the cover bar assembly may be moved to the uppermost position illustrated in FIG. 11 to facilitate product replacement. After the helices are reloaded with product, the cover bar assembly may be repositioned in the operative configuration merely by reversing the movement shown in FIG. 11.

Moreover, through the construction disclosed the cover bar assembly may be moved out of the way as previously described, whereupon the empty spindle may be disengaged from the drive hub, facilitating subsequent insertion of a previously loaded spindle.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and in within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A product vending module for deployment within a coin operated vending machine for selectively dispensing suitable hole punched products, said module comprising:

rigid frame means for operationally mounting said module within said vending machine;

elongated, helical spindle means extending perpendicularly outwardly from said frame means for supporting a plurality of punched products to be vended, said spindle means adapted to be rotated to vend a product, said spindle means comprising convolutions of a first predetermined diameter along a major portion of its length and terminating in integral convolutions of an increased diameter along a lesser portion of its length;

security bar means projecting toward said frame means and interiorly of said increased diameter convolutions of said spindle means for preventing product from moving relative to said convolutions without rotation of said spindle means whereby to prevent an unauthorized vend; and, elongated cover plate means extending above and generally parallel to said spindle means, said cover plate means comprising:

an elongated generally rectangular main body portion disposed above said spindle means and having a remote end terminating adjacent said increased diameter convolutions of said spindle means;

a bracket portion hinged to said frame and pivotally coupled to said main body portion whereby to secure said cover plate means and to permit selective axial displacement of said main body portion relative to said spindle means;

downwardly turned tab means defined at the remote end of said main body portion upon which said security bar means is mounted and from which said security bar means projects toward said frame generally concentrically interiorly of said increased diameter spindle means convolutions; and, spring means normally biasing said bracket portion toward said frame means whereby to yieldably urge said security bar means interiorly of said spindle means.

2. A shake resistant product dispensing module adapted to be mounted within a vending machine for selectively, serially dispensing suitable hole punched products, said module comprising:

rigid, generally planar face plate means for securing said module to a suitable cooperating mounting surface within a vending machine, said planar face plate means having inner and outer faces;

elongated, helical spindle means extending perpendicularly operationally outwardly from said face plate means outer face and adapted to be rotated to vend a punched product carried thereby, said spindle means comprising convolutions of a first predetermined diameter along a major portion of its length and terminating in an increased diameter portion having convolutions larger than said first mentioned convolutions;

motor means associated with said face plate means for rotating said spindle means to vend a product;

cover means emanating outwardly from said face plate means above said spindle means in generally parallel spaced apart relation with respect to said spindle means, said cover means comprising:

an elongated generally rectangular main body portion disposed above said spindle means and having a remote end terminating adjacent said increased diameter portion of said spindle means;

downwardly turned tab means defined at the remote end of said main body portion;

security bar means projecting from said tab means toward said face plate means substantially concentrically interiorly of said larger diameter convolutions of said spindle means for preventing product from moving relative to said last mentioned convolutions without rotation of said spindle means whereby to prevent an unauthorized vend;

bracket means coupled to said face plate means and pivotally coupled to said main body portion whereby to secure and permit selective axial displacement of said main body portion relative to said spindle means for selectively facilitating escape of said security bar means from said convolutions; and, spring means normally biasing said bracket means and said main body portion toward said face plate means whereby to urge said security bar means interiorly of said spindle means.

3. A shake resistant coin operated vending machine for serially dispensing customer-selected punched products, said vending machine comprising:

generally cubicle housing means adapted to be disposed upon a supporting surface, said housing means having a translucent panel permitting visual inspection of the interior of the vending machine, a door permitting service access to the machine interior, and an internal mounting surface;

a plurality of vending modules mounted upon said internal mounting surface for vending a customer selected punched product, each of said vending modules comprising:

rigid frame means for operationally mounting said module within said vending machine upon said internal mounting surface;

elongated, helical spindle means extending perpendicularly outwardly from said frame means for supporting a plurality of punched products to be vended, said spindle means adapted to be rotated to vend a product, said spindle means comprising convolutions of a first predetermined diameter along a major portion of its length and terminating in integral convolutions of an increased diameter along a lesser portion of its length;

security bar means projecting toward said frame means and generally concentrically inwardly of said increased diameter convolutions of said spindle means for preventing product from moving relative to said convolutions without rotation of said spindle means whereby to prevent an unauthorized vend;

elongated cover plate means extending above and generally parallel to said spindle means, each module cover plate means comprising:

an elongated generally rectangular main body portion disposed above said spindle means and having a remote end terminating adajcent said increased diameter convolutions of said spindle means;

a bracket portion hinged to said frame means and pivotally coupled to said main body portion whereby to secure and permit selective axial displacement of said main body portion relative to said frame means;

downwardly turned tab means defined at the remote end of said main body portion upon which said security bar means is mounted and from which said security bar means projects toward said frame; and, spring means normally biasing said bracket portion toward said frame means whereby to yieldably urge said security bar means interiorly of said spindle means; and, coin operated means for selectively actuating a desired one of said plurality of vending modules to effectuate a vend.

4. A coin operated vending machine for serially dispensing customer-selected punched products, said vending machine comprising:

a generally cubicle housing adapted to be disposed upon a supporting surface, said housing comprising a translucent front portion for permitting visual inspection of the vending machine interior;

a plurality of shake resistant product dispensing modules operationally secured within said vending machine interior for selectively, serially dispensing customer selected hole punched products, each of said modules comprising:

rigid, generally planar face plate means for securing each module within said vending machine, said planar face plate means having inner and outer faces;

elongated, helical spindle means extending perpendicularly operationally outwardly from said face plate means outer face and adapted to be rotated to vend a punched product carried thereby, said spindle means comprising convolutions of a first predetermined diameter along a major portion of its length and terminating in an increased diameter portion having convolutions larger than said first mentioned convolutions;

motor means associated with said face plate means for rotating said spindle means to vend a product;

security bar means normally projecting generally concentrically inwardly of said increased diameter convolutions of said spindle means for preventing product from moving rotation of said spindle means whereby to prevent an unauthorized vend;

cover means emanating outwardly from said face plate means above said spindle means in generally parallel spaced apart relation with respect to said spindle means, said cover means comprising:

an elongated generally rectangular main main portion disposed above said spindle means and having a remote end terminating adjacent said increased diameter portion of said spindle means;

downwardly turned tab means defined at the remote end of said main body portion upon which said security bar means is mounted and from which said security bar means normally projects toward said face plate substantially concentrically interiorly of said larger diameter spindle convolutions;

a bracket portion hinged to said frame means and pivotally coupled to said main body portion whereby to secure and permit selective axial displacement of said main body portion relative to said spindle means for selectively facilitating escape of said security bar means from said convolutions; and, spring means normally biasing said bracket portion and said main body portion toward said face plate means whereby to urge said security bar means interiorly of said spindle means; and, coin operated means for selectively actuating a desired one of said plurality of vending modules to effectuate a vend.

* * * * *